US005661856A

United States Patent [19]

Kyte

[11] Patent Number: 5,661,856

[45] Date of Patent: Sep. 2, 1997

[54] PORTABLE TUB

[76] Inventor: Dorothy F. Kyte, 3506 Canyon Crest Rd., Altadena, Calif. 91001

[21] Appl. No.: 558,691

[22] Filed: Nov. 14, 1995

[51] Int. Cl.[6] ..... A47K 3/06

[52] U.S. Cl. ..... 4/584; 4/519; 4/589; 220/4.22

[58] Field of Search ..... 4/526, 528, 529, 4/530, 584, 599, 519, 589, 585; 220/4.21, 4.22, 4.23

[56] References Cited

U.S. PATENT DOCUMENTS

| | | | |
|---|---|---|---|
| 2,188,213 | 1/1940 | Wilson | 4/599 |
| 3,559,216 | 2/1971 | Kyte . | |
| 3,945,058 | 3/1976 | Gardner | 4/530 |
| 4,095,719 | 6/1978 | Wolf | 220/4.22 |
| 4,884,574 | 12/1989 | Hardie et al. | 4/529 |
| 4,993,585 | 2/1991 | McMahon | 220/4.22 |
| 5,370,254 | 12/1994 | Hardigg et al. | 220/4.22 |

*Primary Examiner*—Henry J. Recla
*Assistant Examiner*—Charles R. Eloshway
*Attorney, Agent, or Firm*—William W. Haefliger

[57] ABSTRACT

A portable, collapsible bathtub, that comprises a tub shell having a bottom wall, side walls and end walls, forming a shell, the side wall being longitudinally elongated; the tub having separate shell sections, and a hinge structure interconnecting the sections to pivot from an extended position in which the tub is ready for use and opens upwardly, into a collapsed position in which the sections form an upwardly closed dome shape.

12 Claims, 2 Drawing Sheets

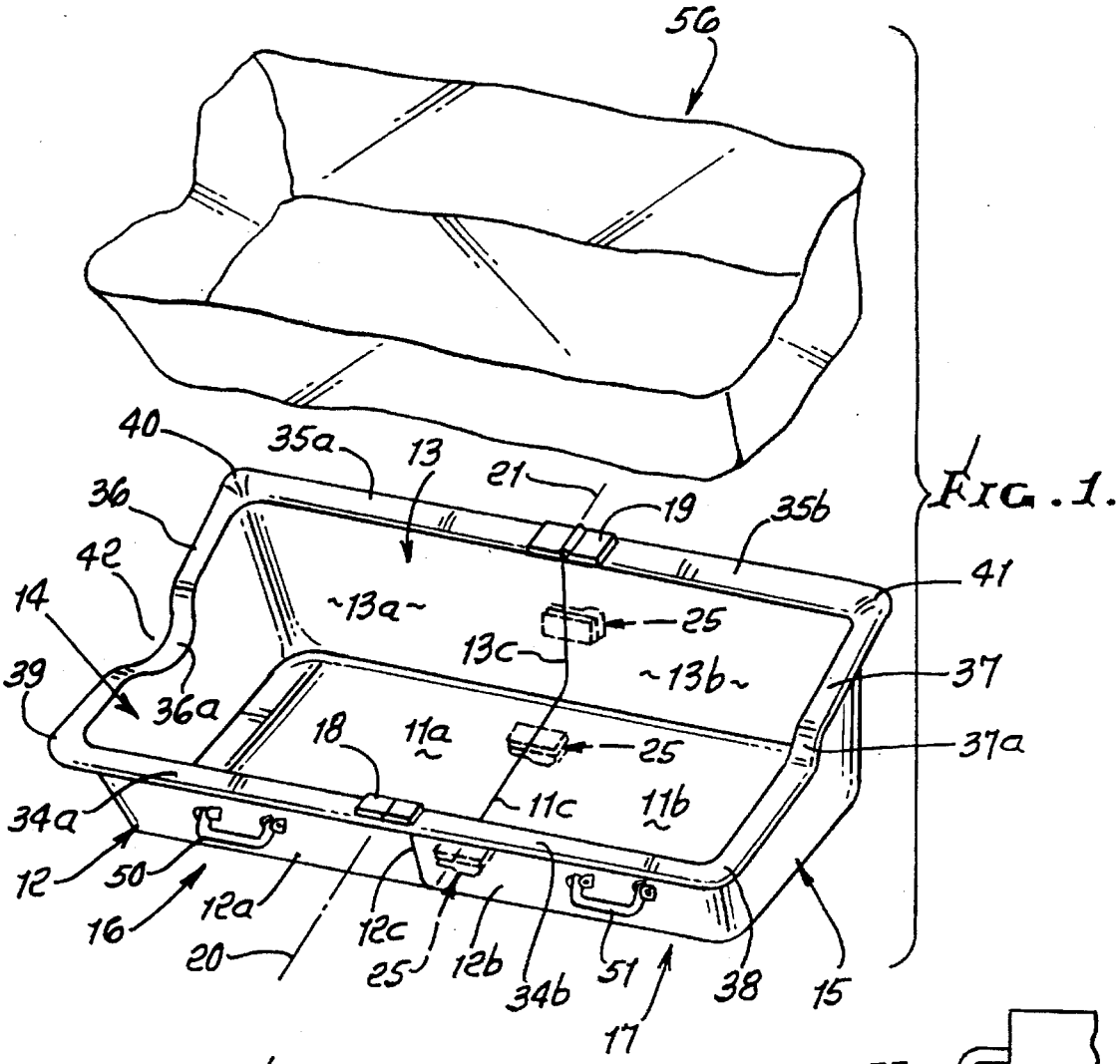
FIG. 1.
FIG. 2.
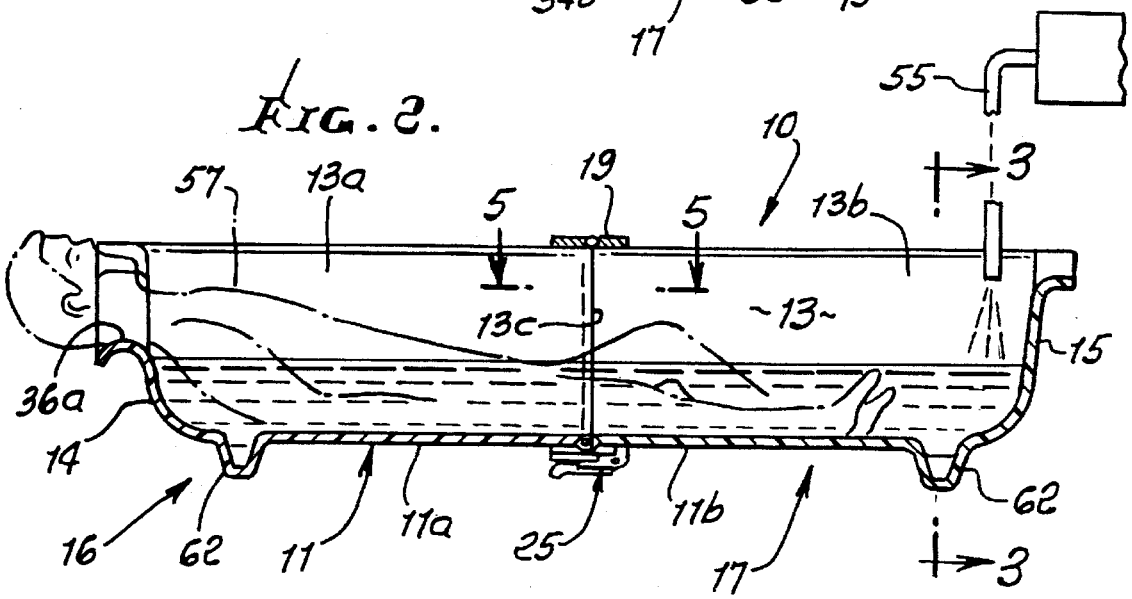

PORTABLE TUB

BACKGROUND OF THE INVENTION

The present invention relates generally to bathtubs and the like, and it is more particularly concerned with a bathtub designed especially for use on a bed to permit bathing a patient who is confined to bed.

The problem of providing adequate bathing for patients confined to bed is a well-known problem occurring in many hospitals, nursing homes, convalescent homes, and the like, for patients who are confined to bed for many days or perhaps weeks. An extension of this problem is the geriatric care of elderly patients who, because of age and infirmity, are confined to bed.

After remaining in bed for considerable time, pressure at various points on the body where it rests upon the bed is apt to produce bed sores, if proper precautions are not taken. The situation can be relieved by turning or otherwise moving the patient, but it can also be helped greatly by daily bathing. It is desirable to immerse the patient in water, if possible, rather than to merely provide a sponge bath, as is common practice in hospitals currently. Soaking the skin in water often helps problems arising from dry skin, and gives an opportunity for effective medication or treatment of the skin. The buoyancy of the body in water aids in reducing pressure on those areas of the skin where the body normally rests and the entire operation generally improves the morale of the patient.

This problem of bathing becomes acute in the case of patients who cannot walk to a bathtub. At the same time, it is not practical to lift patients above the bed in order to place them in a tub of known design resting on the bed, since they would necessarily be lifted over the wall of the usual design of the tub to enter it.

In my prior U.S. Pat. No. 3,559,216, I described one form of the tub apparatus to alleviate the above-discussed problem. There remains need for improvements in tub apparatus having the unusual advantages in construction, mode of operation, and results described herein, and associated with tub portability to and from a patient's bed, as in the case of shut-in patients' homes, to which the portable tub may be carried.

SUMMARY OF THE INVENTION

It is a major object of the invention to provide an improved portable tub apparatus meeting the above-referenced need.

Basically, the apparatus of the invention comprises a collapsible bathtub having a bottom wall, side walls, and end walls, the tub having separate shell sections and hinge means interconnecting those sections to pivot from an extended condition, in which the tub is ready for use and open upwardly, and into a collapsed condition, in which the sections form an upwardly closed dome shape.

Transport means may be attached to the bottom of the shell sections, to be presented upwardly in shell-folded condition, for ease of transport of the collapsed device. The transport means may comprise handles which are moved into proximity as the shell sections are closed into collapsed dome shape. Typically, there are only two sections, each section including a portion of the bottom wall, one of the end walls, and portions of the side walls.

A further object is to provide two portions of the tub bottom wall with rim portions brought into mutual proximity when the sections are pivoted into extended condition, one side wall defining two sections, which are uppermost in tub collapsed condition, and there being handle means on at least one of the uppermost two sections. Such rim portions typically have tongue and groove interfits in the section-extended condition. Seals means may be associated with the tongue and groove interfits and compressed by the first rim portions.

Yet another object is to provide tub shell section side walls with second rim portions brought into mutual proximity when the sections are pivoted into the extended condition. Such second rim portions typically have tongue and groove interfit in the section-extended condition. Seal means may be associated with the second rim portion tongue and groove interfit and compressed by the second rim portions.

A further object is to provide a liner received in the tub to bridge and line the separate sections in the section-extended condition; and such liner may be thin and disposable.

An additional object is to provide latch means carried by the tub to latch together the sections in extended condition thereof.

Further objects and advantages include the provision of ledges on the shell sections adapted to interfit and limit folding; hinge means interconnecting the sections proximate ledge terminals; and legs provided on the separate shell sections.

These and other objects and advantages of the invention, as well as the details of an illustrative embodiment, will be more fully understood from the following specification and drawings, in which:

DRAWING DESCRIPTION

FIG. 1 is a perspective view of tub apparatus embodying the invention;

FIG. 2 is a vertical section taken lengthwise through the tub apparatus;

DETAILED DESCRIPTION

Figure 3:
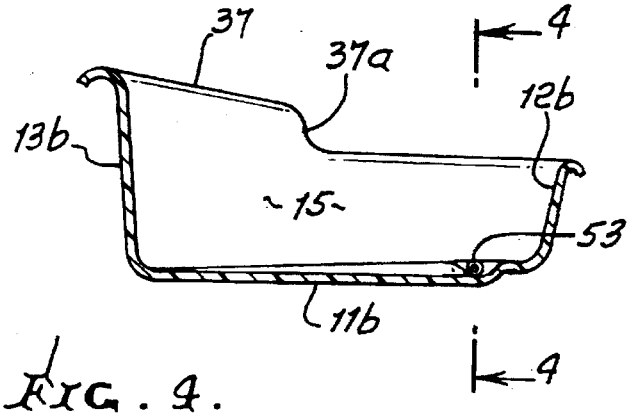
FIG. 3 is a vertical section taken on lines 3—3 of FIG. 2.

Referring to FIGS. 1–3, the tub 10 is in the form of a shell having a-bottom wall 11, side walls 12 and 13, and end walls 14 and 15. The tub comprises separate shell sections indicated at 16 and 17, and hinge means 18 and 19 interconnecting the sections to pivot or hinge about two transverse axes 20 and 21, which are at different elevations on the side walls. Note hinge 18 defining axis 20, at a lesser elevation on top of side wall 12 of relatively lesser height, and hinge 19 defining axis 21 at the top of side wall 13 of relatively greater height. Axis 20 may be angled upwardly and transversely, to intersect axis 21, whereby the two axes 20 and 21 are at an angle or angles relative to the horizontal plane of the bottom wall 11.

Since the tub comprises two shell sections 16 and 17 of approximately equal length, bottom wall 11 is in two sections 11*a* and 11*b* of approximately equal length; side wall 12 is in two sections 12*a* and 12*b;* and side wall 13 is in two sections 13*a* and 13*b* of approximately equal length.

The split between the tub sections is indicated by lines 11*c,* 12*c,* and 13*c* in FIG. 1. Tongue and groove-type external latches 25 interconnect the wall sections 11*a* and 11*b,* and 13*a* and 13*b,* and bridge the splits 11*c* and 13*c,* whereby the tub shell sections are edgewise interconnected and held together by the latches, in their extended positions, as seen in FIG. 2; and the wall inner sides are similarly flush across the splits.

Figure 5:
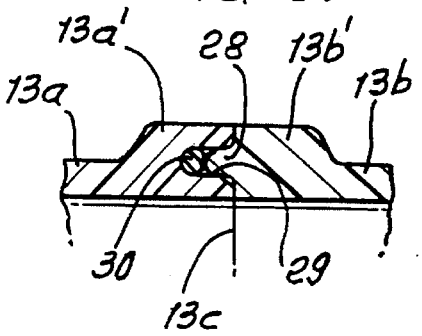
FIG. 5 is an enlarged horizontal section taken through two interfitting side wall sections, and in a plane indicated by lines 5—5 of FIG. 2.
Figure 4:
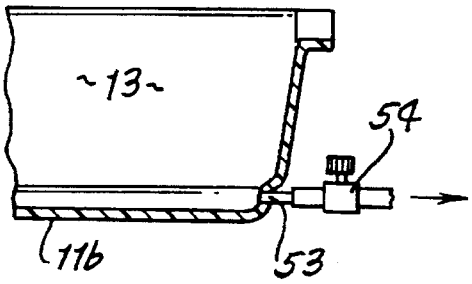
FIG. 4 is a vertical section taken on lines 4—4 of FIG. 3.

FIG. 5 shows the wall sections 13*a* and 13*b,* as having thickened rim portions 13*a*' and 13*b*' enabling provision of closely interfitting tongue 28 and groove 29 elements at split 13*c,* to provide a watertight interfit, as well as a stiffening joint, strengthening the tub at a medial location along its length. An elastomeric seal 30 may be provided in the groove 29 to be compressed by the tongue 28, as shown, to enhance the watertight connection. Such a seal, and the tongue and groove construction, may also be provided at and along the splits 11*c* and 12*c*.

The hinges 18 and 19 are typically provided on adjacent surfaces of laterally flat flange portions 34*a* and 34*b,* and 35*a* and 35*b,* on the uppermost extents of the side walls. See also the laterally flat and sloping flange portions 36 and 37 on the uppermost extents of the end walls. Merging corners of such flanges appear at 38–41. Flange 36 dips sharply at 36*a* to define a neck-receiving concave recess 42 to receive a patient's neck, as also seen in FIG. 2. Flange 37 dips at 37*a,* to define a transition between the lower elevation of flange 34*b* and the higher elevation of flange 35*b*.

Figure 7:
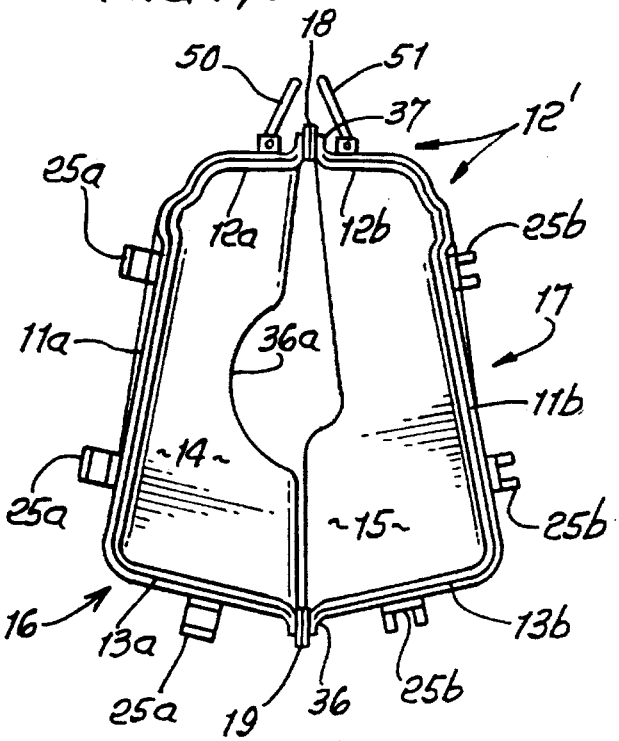
FIG. 7 is an elevation views showing a folded condition of tub sections, and into dome shape, for ease of transportation.

FIG. 7 shows the two shell sections 16 and 17 pivoted upwardly about axes 20 and 21 into collapsed condition forming a dome shape, the side wall sections 12*a* and 12*b* being at the top of the dome, the side wall sections 13*a* and 13*b* being at the bottom of the dome, and the bottom wall sections 11*a* and 11*b* tapering upwardly, for ease of transport. Note handles 50 and 51 on the wall sections 12*a* and 12*b,* and brought close together, for grasping, in FIG. 7. A luggage-type unit is thereby provided. Latch sections appear at 25*a* and 25*b,* in spread apart condition.

A drain is shown at 53 at the lower portion of wall 15; and a drain valve is shown at 54.

FIG. 2 shows water infill at 55, into the extended tub. A tub liner may be employed, as indicated at 56 in FIG. 1; and the liner may be disposable, to obviate need to clean the tub interior after a bath is given to a patient 57.

Figure 8:
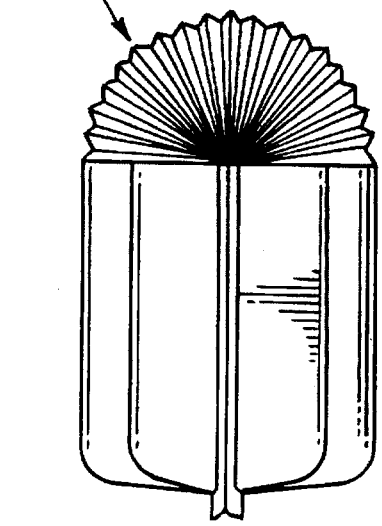
FIG. 8 is a view of a folded, modified tub.

FIG. 8 shows use Of a flexible bellows 59, to bridge the splits 11*c,* 12*c* and 13*c,* to substitute for the tongue and groove elements and seal, as seen in FIG. 5. Tub legs appear at 62.

Figure 6:
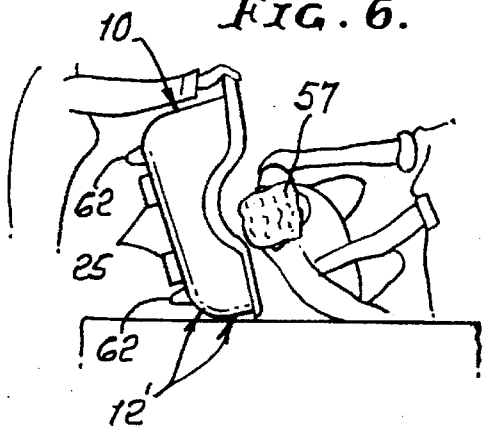
FIG. 6 is an endwise view showing the position of the tub relative to a patient during the process of placing a patient into, or removing him, from a tub.

Reference is now made to FIG. 6. While all of the tub walls are joined by curves or fillets, as is common practice in molding, and in order to eliminate any sharp corners which are difficult to clean, front wall 12 and bottom wall 11 are connected by curved sections of walls indicated at 12' having a relatively large radius. This radius may be somewhat larger than shown, and, as will become apparent, should be as large as possible. Generally speaking, the radius is desirably at least equal to half of the total vertical height of wall 13 above the bed, since a lesser radius reduces the adaptability of the tub to rocking or "rolling" on this curved rocker surface for the purpose of placing a patient in or removing a patient from the tub.

It will be seen that, if a tub with the usual fillet corner were to be rocked thereon, great force would have to be exerted to lift the tub and patient until the center of gravity of the tub and patient reached and then passed vertical alignment with the point of contact of the tub corner with its support. Immediately thereafter, the tub tends to fall to the other side, and must be sustained with great effort against falling. With the large radius rocker or roller surface on which to turn, the tub and patient 57 can easily be rolled over, barrel-like, without strenuous effort on the part of the operator.

FIG. 6 shows how the side 12 of the bathtub can be slipped underneath a patient lying on the bed when the patient has rolled over on one side, so that the patient, by then rolling over on his back, rolls into the tub. By then rocking the tub in a counterclockwise direction to bring the bottom of it down upon the bed, the tub rocks on the top surface of the bed, and in so doing the patient slides down along the curved surface onto the bottom of the tub. Though not necessary, it is preferred that the top edge of the front wall 12 have a short radius curve to avoid a sharp edge in contact with the patient.

The tub sections may consist of molded plastic material in sheet form.

A Disclosure Document No. 377096 has been filed in the Patent and Trademark Office.

I claim:

1. A portable, collapsible bathtub comprising:

a) a foldable tub shell divided into separate sections, each section having a bottom wall, side walls extending upwardly from said bottom wall, and an end wall connected to said side walls and said bottom wall, said bottom and side walls terminating in end edges, said edges being complementarily configured and sealingly engageable with each other, b) said side walls of each section extending upwardly from said section bottom wall to a side wall terminal end, said terminal ends each being at a different elevation from said bottom wall, c) said section side walls being hingedly connected to each other such that in an unfolded use position of the bathtub, said edges are substantially engaged and said shell lies flat on a horizontal surface and is upwardly open to receive water therein and in a folded collapsed position said sections are folded such that said terminal ends are adjacent one another, and d) a hinge provided on each terminal end, bridging said edges, each hinge having an axis, said axes being arranged so as to substantially intersect.

2. The combination of claim 1 including transport means attached to said shell sections for transporting the tub in said section collapsed condition with the transport means projecting from the bottom of the shell sections.

3. The combination of claim 2 wherein said transport means includes handle means presented upwardly in said collapsed position.

4. The combination of claim 3 wherein said handle means comprises a handle on each section, said two handles moved into mutual proximity when the sections are pivoted into said collapsed position.

5. The combination of claim 1 wherein said end edges have tongue and groove interfits which mate in said use position.

6. The combination of claim 5 including seal means associated with said tongue and groove interfits.

7. The combination of claim 1 including a liner received in said tub to bridge and line said separate sections in said use position.

8. The combination of claim 1 including latch means carried by the tub to latch together the sections in said collapsed position thereof.

9. The combination of claim 1 wherein one of said end walls forms an upwardly exposed depression sized to receive a neck of a patient.

10. The combination of claim 1 wherein said terminal ends have upwardly exposed rims in said use position.

11. The combination of claim 10 wherein said sections comprise molded plastic material in sheet form.

12. The combination of claim 9 wherein said sections comprise molded plastic material in sheet form.

* * * * *